US012796817B2

(12) United States Patent
Lv et al.

(10) Patent No.: US 12,796,817 B2
(45) Date of Patent: Nov. 17, 2026

(54) HANGING BASKET CHAIR FRAME AND HANGING BASKET CHAIR

(71) Applicant: AnHui HanTang Leisure Products Co., LTD., Suzhou City (CN)

(72) Inventors: Liang Lv, Suzhou City (CN); Chongxin Yang, Suzhou City (CN); Jining Yang, Suzhou City (CN)

(73) Assignee: AnHui HanTang Leisure Products Co., LTD., Suzhou City (CN)

( * ) Notice: Subject to any disclaimer, the term of this patent is extended or adjusted under 35 U.S.C. 154(b) by 107 days.

(21) Appl. No.: 19/031,272

(22) Filed: Jan. 17, 2025

(65) Prior Publication Data

US 2026/0123752 A1 May 7, 2026

(30) Foreign Application Priority Data

Nov. 4, 2024 (CN) ..... 202422682894.9

(51) Int. Cl.

| | |
|---|---|
| ***A47C 4/28*** | (2006.01) |
| ***A47C 3/12*** | (2006.01) |
| ***A47C 4/00*** | (2006.01) |
| ***A47C 4/30*** | (2006.01) |
| ***A47C 4/48*** | (2006.01) |

(52) U.S. Cl.

CPC . *A47C 3/12* (2013.01); *A47C 4/00* (2013.01)

(58) Field of Classification Search

CPC .. A47C 4/286; A47C 4/02; A47C 4/03; A47C 7/008; A47C 9/10

See application file for complete search history.

(56) References Cited

U.S. PATENT DOCUMENTS

| | | | | |
|---|---|---|---|---|
| 6,634,705 | B1 * | 10/2003 | Zheng | A47C 4/286 297/41 |
| 6,752,414 | B1 * | 6/2004 | Waldron | A47C 4/286 297/16.2 |
| 6,926,356 | B2 * | 8/2005 | Chen | A47C 4/286 297/35 |
| 7,066,534 | B2 * | 6/2006 | Choi | A47C 4/286 297/16.2 |
| 7,404,601 | B2 * | 7/2008 | Chen | A47C 4/44 297/16.2 |
| 7,758,111 | B2 * | 7/2010 | Chen | A47C 4/286 297/16.2 |

(Continued)

*Primary Examiner* — Shin H Kim

(74) *Attorney, Agent, or Firm* — Kermit D. Lopez; Luis M. Ortz; KPPB Law

(57) ABSTRACT

A hanging basket chair frame and a hanging basket chair are provided. The hanging basket chair frame includes a linkage mechanism, two upright posts, folding legs, two sliding members, and two pull rods. The linkage mechanism includes two linkages intersecting with each other and being hinged to each other at the intersection. The two upright posts are respectively arranged on two sides of the linkage mechanism. Multiple folding legs are movably arranged on each of the upright posts. The sliding members are slidably arranged on the upright posts. Upper ends of the linkages are respectively hinged to the two sliding members, and lower ends of the linkages are respectively hinged to the upright posts. The two pull rods are hinged to each other, and ends of the two pull rods away from each other are respectively hinged to upper parts of the two linkages.

16 Claims, 4 Drawing Sheets

(56) References Cited

U.S. PATENT DOCUMENTS

| | | | | |
|---|---|---|---|---|
| 8,820,825 | B2 * | 9/2014 | Yang | A47C 4/286 297/21 |
| 10,206,510 | B2 * | 2/2019 | Choi | A47C 4/286 |
| 10,455,942 | B2 * | 10/2019 | Chen | A47C 4/02 |
| 10,786,083 | B1 * | 9/2020 | Chen | A47C 4/286 |
| 11,259,638 | B2 * | 3/2022 | Chen | A47C 4/286 |
| D1,104,587 | S * | 12/2025 | Shi | D6/708.16 |
| 2002/0070532 | A1 * | 6/2002 | Harrison | A61G 5/0825 280/647 |
| 2006/0249991 | A1 * | 11/2006 | Hsieh | A47C 4/48 297/16.1 |
| 2015/0265054 | A1 * | 9/2015 | Choi | A47C 4/286 297/45 |
| 2015/0359339 | A1 * | 12/2015 | Choi | A47C 4/286 297/42 |
| 2017/0027327 | A1 * | 2/2017 | Homans | A47C 1/146 |
| 2017/0181547 | A1 * | 6/2017 | Yang | A47C 4/28 |
| 2019/0290007 | A1 * | 9/2019 | Chen | A47C 4/286 |
| 2019/0350364 | A1 * | 11/2019 | Yang | A47C 1/0342 |
| 2020/0275771 | A1 * | 9/2020 | Zhu | A47C 4/286 |
| 2023/0165373 | A1 * | 6/2023 | Chen | A47C 4/30 297/19 |
| 2026/0123752 | A1 * | 5/2026 | Lv | A47C 3/12 |

* cited by examiner

HANGING BASKET CHAIR FRAME AND HANGING BASKET CHAIR

CROSS-REFERENCE TO RELATED APPLICATION

This patent application claims the benefit and priority of Chinese Patent Application No. 2024226828949 filed with the China National Intellectual Property Administration on Nov. 4, 2024, the disclosure of which is incorporated by reference herein in its entirety as part of the present application.

TECHNICAL FIELD

The present disclosure relates to the technical field of hanging basket chairs, and in particular to a hanging basket chair frame and a hanging basket chair.

BACKGROUND

In daily life, hanging basket chairs are widely used due to their portability and comfort. However, in the existing hanging basket chairs on the market, latches are provided on two upright posts, during unfolding and folding, the latches on the upright posts on two sides need to be operated in sequence so as to achieve locking and unlocking, and the products with latches on two sides are inconvenient and have a high cost. On this basis, there is an urgent need for a new solution to solve the above problem.

SUMMARY

The objective of the present disclosure is to provide a hanging basket chair frame and a hanging basket chair to solve the problem in the conventional art described above so as to improve convenience and reduce costs.

To achieve the above objective, the present disclosure provides the following technical solution.

The present disclosure provides a hanging basket chair frame having a folded state and an unfolded state, and including:

- a linkage mechanism including two linkages intersecting with each other and being hinged to each other at an intersection;
- two upright posts respectively arranged on two sides of the linkage mechanism;
- folding legs, where multiple folding legs are movably arranged on each of the two upright posts;
- two sliding members, where the two sliding members are respectively slidably arranged on the two upright posts in a length direction of the two upright posts, each of the two sliding members is connected to two of the folding legs, upward sliding of the two sliding members along the two upright posts is capable of driving the folding legs to be switched to the unfolded state, downward sliding of the two sliding members along the two upright posts is capable of driving the folding legs to be switched to the folded state, upper ends of the two linkages are respectively hinged to the two sliding members, and lower ends of the two linkages are respectively hinged to the two upright posts; and
- two pull rods hinged to each other, where ends of the two pull rods away from each other are respectively hinged to upper parts of the two linkages.

Preferably, the hanging basket chair frame further includes a locking member, the locking member is arranged at a hinged portion of the two pull rods and configured for limiting the two linkages in the unfolded state from rotating relative to each other.

Preferably, the two pull rods include a first pull rod and a second pull rod, the locking member is fixedly connected to the first pull rod, a part of the locking member is located on a side of the second pull rod, a clamp slot is formed on the locking member on the side of the second pull rod and has an opening facing the second pull rod, when the hanging basket chair frame is switched from the folded state to the unfolded state, the second pull rod rotates relative to the first pull rod until the second pull rod enters the clamp slot; the opening of the clamp slot has a smaller width than the second pull rod, and at least a structure of the opening of the clamp slot is made of a resilient material.

Preferably, a handle or a pull ring is arranged on the locking member.

Preferably, each of the folding legs includes two leg rods hinged to each other, and ends of the two leg rods away from each other are respectively hinged to a corresponding one of the two sliding members and a bottom of a corresponding one of the two upright posts; and hinged portions of the folding legs in the unfolded state are configured to be supported on the ground.

Preferably, the two sliding members are sliding sleeves, and the sliding sleeves are sleeved on the two upright posts.

Preferably, two of the folding legs are arranged on each of the two upright posts, and are arranged symmetrically about a plane in which the two upright posts lie.

Preferably, bottoms of the upright posts are suspended when in the unfolded state.

Compared with the conventional art, the present disclosure achieves the following technical effects.

The present disclosure abandons the method of providing latches on upright posts on two sides in the conventional art, and instead provides two pull rods on the linkage mechanism. The two pull rods can rotate relative to each other to switch the state of the hanging basket chair frame. When the hanging basket chair frame is switched from the folded state to the unfolded state, the two linkages rotate downwardly to drive the two pull rods to rotate until an angle of rotation of the two pull rods reaches the maximum, at this point, the two pull rods will limit further rotation of the two linkages, such that the hanging basket chair frame can still be kept in the unfolded state when subjected to a downward pressure (people are sitting on the hanging basket chair), and when folding, the two pull rods are pulled upwardly or the two upright posts are brought closer to each other to achieve folding. Therefore, in the present application, the convenience of use of a hanging basket chair is improved, the manufacturing process of the pull rod is much simpler than that of the latch having a complicated structure, and thus the cost of manufacturing can also be reduced.

BRIEF DESCRIPTION OF THE DRAWINGS

To illustrate the technical solutions in the embodiments of the present disclosure or conventional art more clearly, the accompanying drawings required for the embodiments are briefly described below. Apparently, the accompanying drawings in the following description show merely some embodiments of the present disclosure, and those of ordinary skill in the art may still derive other accompanying drawings from these accompanying drawings without creative efforts.

List of reference signs: 1 linkage mechanism; 11 linkage; 2 upright post; 3 folding leg; 31 leg rod; 4 sliding member; 5 pull rod; 51 first pull rod; 52 second pull rod; 6 locking member; 7 pull ring.

DETAILED DESCRIPTION OF THE EMBODIMENTS

The technical solutions of the present disclosure will be clearly and completely described below with reference to the accompanying drawings in the embodiments of the present disclosure. Apparently, the embodiments described are merely some rather than all of the embodiments of the present disclosure. On the basis of the embodiments of the present disclosure, all other embodiments obtained by a person of ordinary skill in the art without creative labor shall fall within the scope of protection of the present disclosure.

In order to make the above objectives, features and advantages of the present disclosure more apparently understandable, the present disclosure will be further described in detail below with reference to the accompanying drawings and the particular embodiments.

Figure 1:
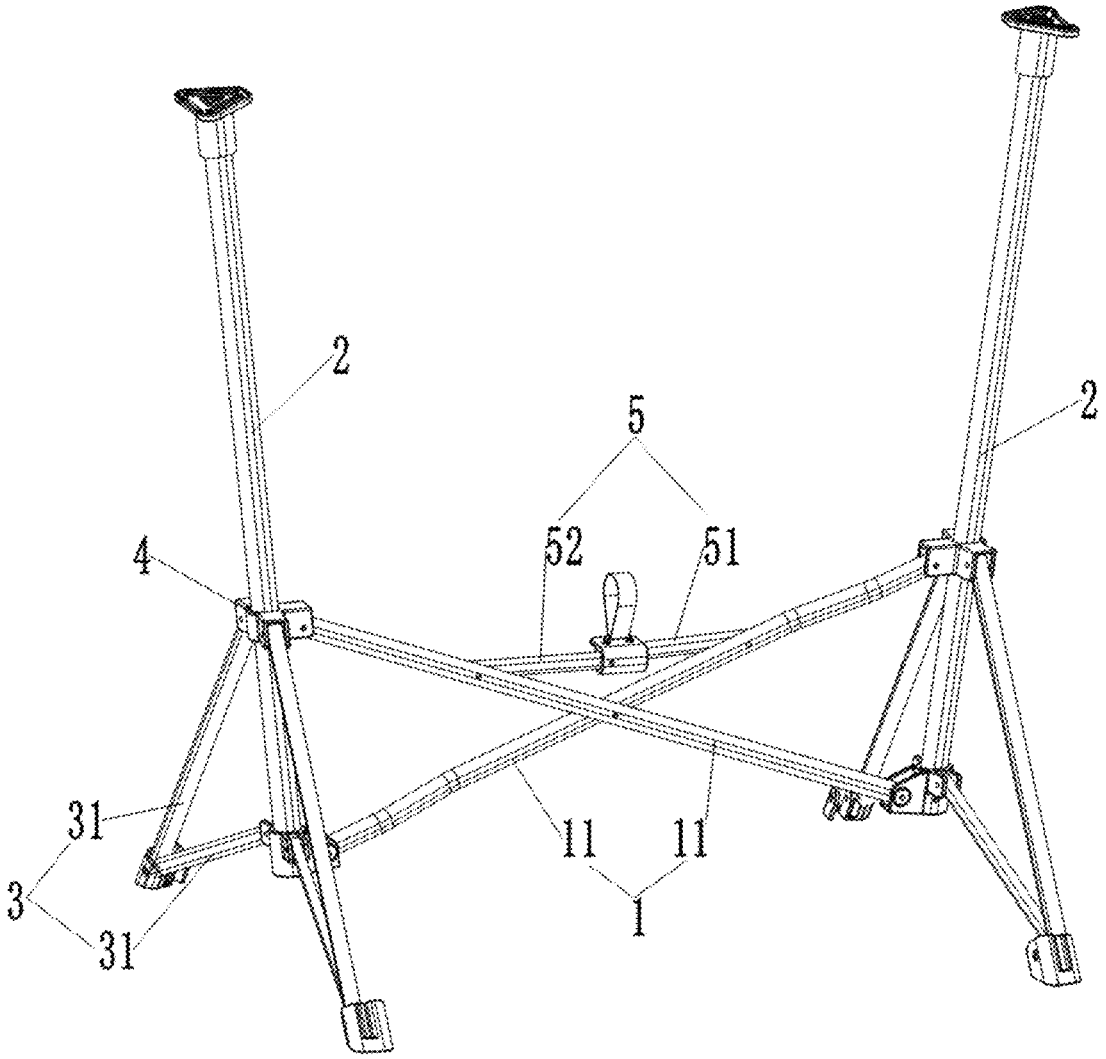
FIG. 1 is a schematic structural diagram of a hanging basket chair frame according to an embodiment of the present disclosure in an unfolded state.
Figure 2:
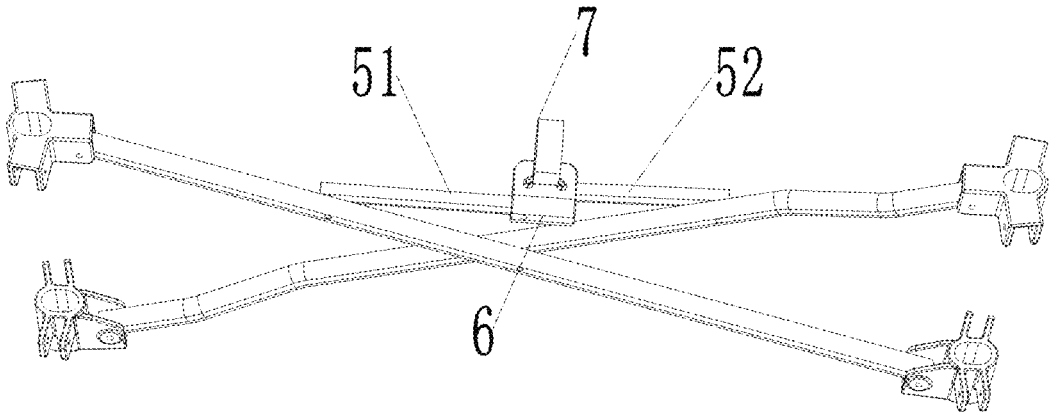
FIG. 2 is a schematic structural diagram of a linkage mechanism, pull rods and a locking member in FIG. 1.
Figure 3:
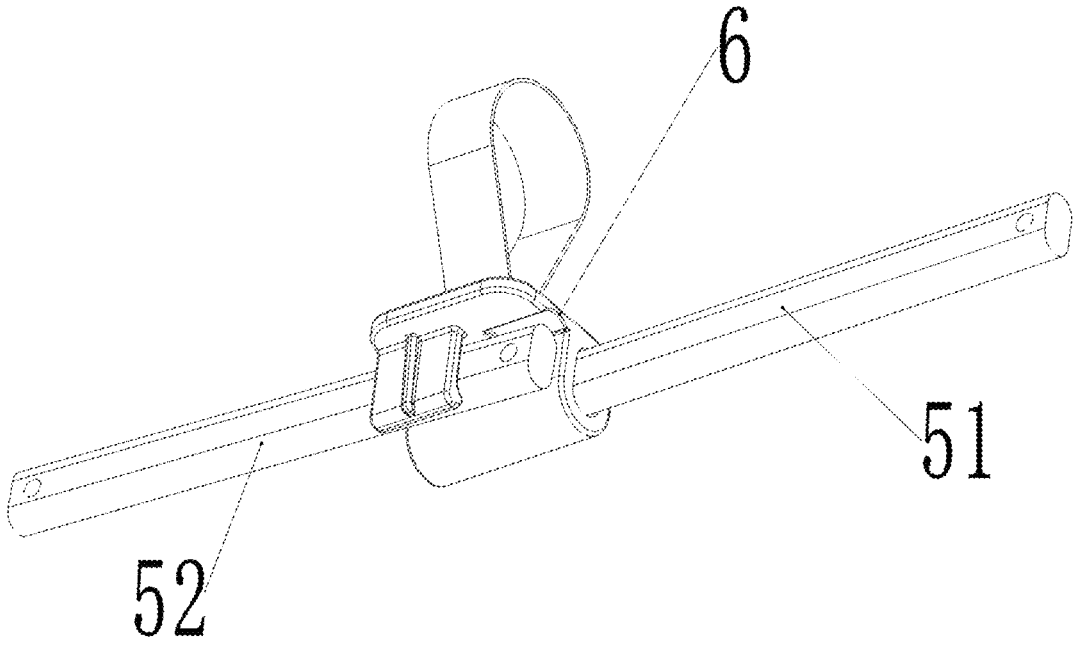
FIG. 3 is a schematic structural diagram of the pull rods and the locking member in FIG. 2.
Figure 4:
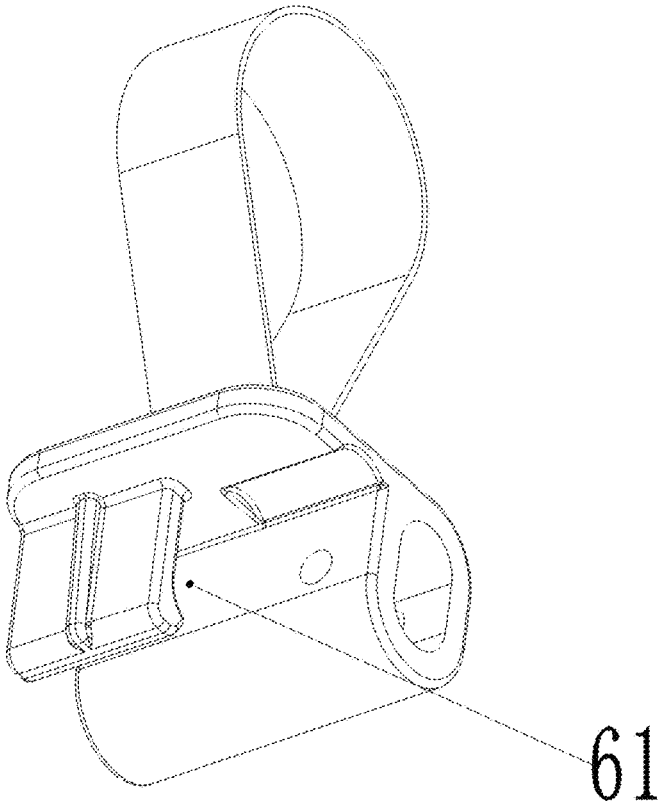
FIG. 4 is a schematic structural diagram of a locking member.
Figure 5:
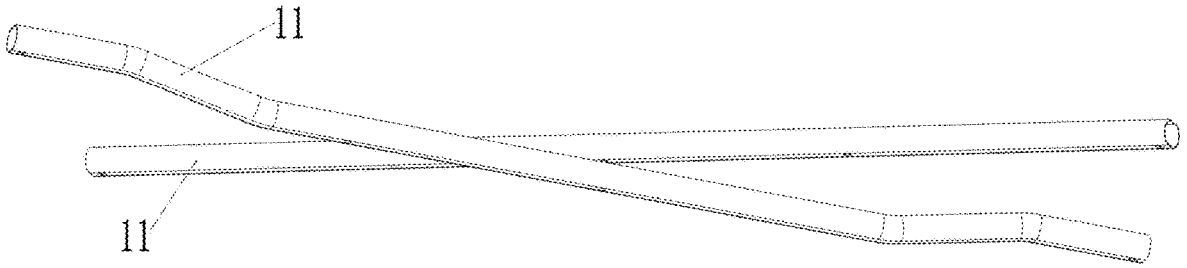
FIG. 5 is a schematic structural diagram of the linkage mechanism in FIG. 1.
Figure 6:
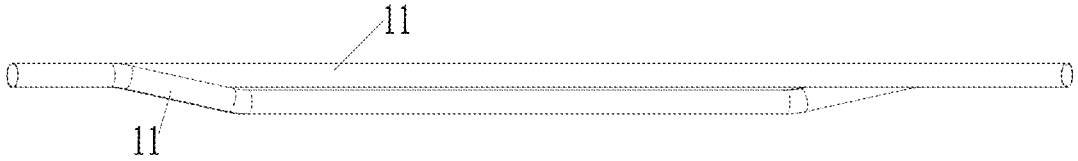
FIG. 6 is a top view of FIG. 5.
Figure 7:
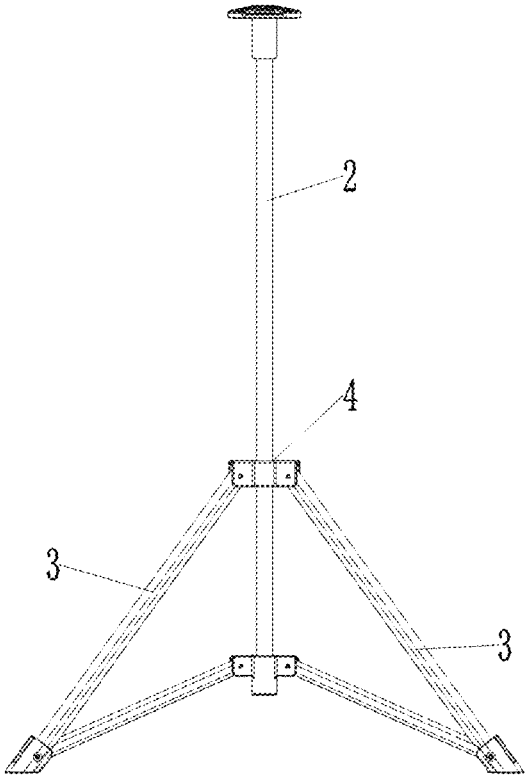
FIG. 7 is a schematic structural diagram of one upright post and folding legs thereon in an unfolded state.

The present disclosure provides a hanging basket chair frame having a folded state and an unfolded state, and as shown in FIGS. 1 to 7, including: a linkage mechanism 1, two upright posts 2, folding legs 3, two sliding members 4, and two pull rods 5.

The linkage mechanism 1 includes two linkages 11 intersecting with each other and being hinged to each other at the intersection.

The two upright posts 2 are respectively arranged on two sides of the linkage mechanism 1. The linkage mechanism 1 is configured to connect the upright posts 2 on two sides, and the upright posts 2 are configured to support a chair seat. It will be appreciated that the folded state and the unfolded state mentioned above may also be referred to as the chair seat being folded and unfolded. Therefore, the two upright posts 2 are close to each other in the folded state, and the two upright posts 2 are away from each other in the unfolded state.

Multiple folding legs 3 are movably provided on each of the upright posts 2, and the folding legs 3 are configured to be unfolded so as to be supported on the ground or to be folded so as to reduce the volume.

The two sliding members 4 are respectively slidably arranged on the upright posts 2 in a length direction of the two upright posts 2. Each of the two sliding members 4 is connected to two folding legs 3. Upward sliding of the sliding member 4 along the upright post 2 can drive the folding legs 3 to be switched to the unfolded state, and downward sliding of the sliding member 4 along the upright post 2 can drive the folding legs 3 to be switched to the folded state. Upper ends of the two linkages 11 are respectively hinged to the two sliding members 4; and lower ends of the two linkages 11 are respectively hinged to the two upright posts 2.

The two pull rods 5 are hinged to each other, and ends of the two pull rods 5 away from each other are respectively hinged to upper parts of the two linkages 11.

The present disclosure abandons the method of providing latches on upright posts 2 on two sides in the conventional art, and instead provides two pull rods 5 on the linkage mechanism 1. The two pull rods 5 can rotate relative to each other to switch the state of the hanging basket chair frame. When the hanging basket chair frame is switched from the folded state to the unfolded state, the two linkages 11 rotate downwardly to drive the two pull rods 5 to rotate until an angle of rotation of the two pull rods 5 reaches the maximum, at this point, the two pull rods 5 will limit further rotation of the two linkages 11, such that the hanging basket chair frame can still be kept in the unfolded state when subjected to a downward pressure (people are sitting on the hanging basket chair), and when folding, the two pull rods 5 are pulled upwardly or the two upright posts 2 are brought closer to each other to achieve folding. Therefore, in the present application, the convenience of use of a hanging basket chair is improved, the manufacturing process of the pull rod 5 is much simpler than that of the latch having a complicated structure, and thus the cost of manufacturing can also be reduced.

In some embodiments, the embodiment of the present disclosure further includes a locking member 6, and the locking member 6 is arranged at a hinged portion of the two pull rods 5 and limits the two linkages 11 in the unfolded state from rotating relative to each other.

This embodiment is intended to avoid the instability and proneness to upward folding of the hanging basket chair frame when moved in the unfolded state. Therefore, the locking member 6 is configured to fix the relative position of the two linkages 11 in the unfolded state, thus functioning to stabilize the hanging basket chair frame in the unfolded state.

Specifically, the following structure may be used for the locking member 6. For ease of understanding, the two pull rods 5 are defined as a first pull rod 51 and a second pull rod 52, respectively. The locking member 6 is fixedly connected to the first pull rod 51, a part of the locking member 6 is located on a side of the second pull rod 52, a clamp slot is formed on the locking member 6 on the side of the second pull rod 52 and has an opening facing the second pull rod 52. When the hanging basket chair frame is switched from the folded state to the unfolded state, the second pull rod 52 rotates relative to the first pull rod 51 until it enters the clamp slot. The opening of the clamp slot has a smaller width than the second pull rod 52, and at least a structure of the opening of the clamp slot is made of a resilient material selected from plastic, rubber, metal and the like.

In this embodiment, the clamp slot is provided, and the opening of the clamp slot has a smaller width than the second pull rod 52, such that when the second pull rod 52 rotates to the unfolded state relative to the first pull rod 51, the second pull rod 52 can just enter the clamp slot. The width of the opening of the clamp slot being smaller than the width of the second pull rod 52 functions to limit the second pull rod 52 so as to prevent the second pull rod 52 from being easily removed from the clamp slot. When the hanging basket chair frame needs to be folded, due to the resilience of the structure at the opening, the locking member 6 can be manually pulled upwardly to enable the second pull rod 52 to be removed from the clamp slot, thereby achieving unlocking. Compared with the solution of providing a latch or a pin on the upright post 2 in the conventional art, the unlocking process according to the embodiment of the present disclosure is simple and easy to implement.

In some embodiments, a handle or a pull ring 7 is arranged on the locking member 6.

This embodiment makes it easier for a user to lift the locking member 6 by a hand for unlocking.

In some embodiments, the folding leg 3 includes two leg rods 31 hinged to each other, and ends of the two leg rods 31 away from each other are respectively hinged to the sliding member 4 and the bottom of the upright post 2. A hinged portion of the folding legs 3 in the unfolded state is configured to be supported on the ground.

In this embodiment, the downward sliding of the sliding member 4 on the upright post 2 drives the two leg rods 31 of the folding leg 3 to rotate relative to each other and to enable the hinged portion to move downwardly.

In some embodiments, the sliding member 4 is a sliding sleeve, and the sliding sleeve is sleeved on the upright post 2.

In this embodiment, the solution of sleeving and sliding on the upright posts 2 is more stable than the other sliding connections.

In some embodiments, two folding legs 3 are arranged on each of the upright post 2, and the two folding legs 3 are arranged symmetrically about a plane in which the two upright posts 2 lie. Of course, in other embodiments, three or four folding legs 3 may also be arranged on one upright post 2, which increases the volume of a device, but also increases the stability of the device in the unfolded state.

In some embodiments, the bottom of the upright post 2 is suspended when in the unfolded state.

Compared with the solution of the conventional art in which the bottom of the upright post 2 also abuts against the ground, in the embodiment of the present disclosure, the length of the upright post 2 is reduced, which can reduce the height after folding and further reduce the volume after folding.

An embodiment of the present disclosure also provides a hanging basket chair including a hanging basket chair frame as described above and a chair seat.

This embodiment of the present disclosure has all the advantages of the embodiment of the hanging basket chair frame described above, which will not be described in detail here.

In the present disclosure, the principle and embodiments are described herein by using specific examples, the above descriptions of the embodiments are merely intended to help understand the methods and core idea of the present disclosure. In addition, for those of ordinary skill in the art, changes may be made to the specific embodiments and the scope of application according to the concept of the present disclosure. In summary, the content of the description should not be construed as a limitation to the present disclosure.

What is claimed is:

1. A hanging basket chair frame having a folded state and an unfolded state, comprising:

a linkage mechanism comprising two linkages intersecting with each other and being hinged to each other at an intersection;

two upright posts respectively arranged on two sides of the linkage mechanism;

folding legs, wherein a plurality of folding legs are movably arranged on each of the two upright posts;

two sliding members, wherein the two sliding members are respectively slidably arranged on the two upright posts in a length direction of the two upright posts, each of the two sliding members is connected to two of the folding legs, upward sliding of the two sliding members along the two upright posts is capable of driving the folding legs to be switched to the unfolded state, downward sliding of the two sliding members along the two upright posts is capable of driving the folding legs to be switched to the folded state, upper ends of the two linkages are respectively hinged to the two sliding members, and lower ends of the two linkages are respectively hinged to the two upright posts; and two pull rods hinged to each other, wherein ends of the two pull rods away from each other are respectively hinged to upper parts of the two linkages.

2. The hanging basket chair frame according to claim 1, further comprising a locking member, wherein the locking member is arranged at a hinged portion of the two pull rods and configured for limiting the two linkages in the unfolded state from rotating relative to each other.

3. The hanging basket chair frame according to claim 2, wherein the two pull rods comprise a first pull rod and a second pull rod, the locking member is fixedly connected to the first pull rod, a part of the locking member is located on a side of the second pull rod, a clamp slot is formed on the locking member on the side of the second pull rod and has an opening facing the second pull rod, when the hanging basket chair frame is switched from the folded state to the unfolded state, the second pull rod rotates relative to the first pull rod until the second pull rod enters the clamp slot; the opening of the clamp slot has a smaller width than the second pull rod, and at least a structure of the opening of the clamp slot is made of a resilient material.

4. The hanging basket chair frame according to claim 2, wherein a handle or a pull ring is arranged on the locking member.

5. The hanging basket chair frame according to claim 1, wherein each of the folding legs comprises two leg rods hinged to each other, and ends of the two leg rods away from each other are respectively hinged to a corresponding one of the two sliding members and a bottom of a corresponding one of the two upright posts; and hinged portions of the folding legs in the unfolded state are configured to be supported on the ground.

6. The hanging basket chair frame according to claim 1, wherein the two sliding members are sliding sleeves, and the sliding sleeves are sleeved on the two upright posts.

7. The hanging basket chair frame according to claim 1, wherein two of the folding legs are arranged on each of the two upright posts, and are arranged symmetrically about a plane in which the two upright posts lie.

8. The hanging basket chair frame according to claim 1, wherein bottoms of the upright posts are suspended when in the unfolded state.

9. A hanging basket chair, comprising a hanging basket chair frame according to claim 1.

10. The hanging basket chair according to claim 9, further comprising a locking member, wherein the locking member is arranged at a hinged portion of the two pull rods and configured for limiting the two linkages in the unfolded state from rotating relative to each other.

11. The hanging basket chair frame according to claim 10, wherein the two pull rods comprise a first pull rod and a second pull rod, the locking member is fixedly connected to the first pull rod, a part of the locking member is located on a side of the second pull rod, a clamp slot is formed on the locking member on the side of the second pull rod and has an opening facing the second pull rod, when the hanging basket chair frame is switched from the folded state to the unfolded state, the second pull rod rotates relative to the first pull rod until the second pull rod enters the clamp slot; the opening of the clamp slot has a smaller width than the second pull rod, and at least a structure of the opening of the clamp slot is made of a resilient material.

12. The hanging basket chair frame according to claim 10, wherein a handle or a pull ring is arranged on the locking member.

13. The hanging basket chair frame according to claim 9, wherein each of the folding legs comprises two leg rods hinged to each other, and ends of the two leg rods away from each other are respectively hinged to a corresponding one of the two sliding members and a bottom of a corresponding one of the two upright posts; and hinged portions of the folding legs in the unfolded state are configured to be supported on the ground.

14. The hanging basket chair frame according to claim 9, wherein the two sliding members are sliding sleeves, and the sliding sleeves are sleeved on the two upright posts.

15. The hanging basket chair frame according to claim 9, wherein two of the folding legs are arranged on each of the two upright posts, and are arranged symmetrically about a plane in which the two upright posts lie.

16. The hanging basket chair frame according to claim 9, wherein bottoms of the upright posts are suspended when in the unfolded state.

* * * * *